US011530699B2

(12) United States Patent
Eschner

(10) Patent No.: US 11,530,699 B2
(45) Date of Patent: Dec. 20, 2022

(54) HORIZONTALLY SPLIT SCREW-SPINDLE PUMP

(71) Applicant: Klaus Union GmbH & Co. KG, Bochum (DE)

(72) Inventor: Thomas Eschner, Bochum (DE)

(73) Assignee: Klaus Union GmbH & Co. KG, Bochum (DE)

( * ) Notice: Subject to any disclaimer, the term of this patent is extended or adjusted under 35 U.S.C. 154(b) by 294 days.

(21) Appl. No.: 16/345,597

(22) PCT Filed: Oct. 27, 2017

(86) PCT No.: PCT/EP2017/077555
§ 371 (c)(1),
(2) Date: Apr. 26, 2019

(87) PCT Pub. No.: WO2018/078073
PCT Pub. Date: May 3, 2018

(65) Prior Publication Data

US 2019/0249662 A1 Aug. 15, 2019

(30) Foreign Application Priority Data

Oct. 27, 2016 (DE) ..... 102016120579.6

(51) Int. Cl.
*F04D 29/62* (2006.01)
*F04D 29/40* (2006.01)
(Continued)

(52) U.S. Cl.
CPC ..... *F04C 2/16* (2013.01); *F01C 21/10* (2013.01); *F04C 15/0003* (2013.01);
(Continued)

(58) Field of Classification Search
CPC ..... F04C 2/16; F04C 2240/30; F04C 2/165; F04C 2/086; F01C 21/10; F04D 29/624; F04D 29/40
See application file for complete search history.

(56) References Cited

U.S. PATENT DOCUMENTS 2,381,695 A * 8/1945 Sennet ..... F04C 2/16 417/252
2,590,560 A * 3/1952 Montelius ..... F04C 15/0042 418/149
(Continued)

FOREIGN PATENT DOCUMENTS

DE 716161 1/1942
DE 2001015 10/1970
(Continued)

OTHER PUBLICATIONS

International Search Report with English Translation issued in the corresponding International Patent Application No. PCT/EP2017/077555, dated Jan. 23, 2018 (7 pages).
(Continued)

*Primary Examiner* — Deming Wan
(74) *Attorney, Agent, or Firm* — Adams and Reese LLP; Ray R. Ferrera

(57) ABSTRACT

The invention relates to a screw pump (1), in particular a double screw pump, s comprising a multiple-piece housing (2, 7, 15, 21) and at least two coupled rotors (3, 3*a*) which form chambers with in each case at least one thread-shaped profile (4, 4*a*) which is configured at least in regions with helical channels (5, 5*a*) and with dividing walls (6, 6*a*) which delimit the channels (5, 5*a*), wherein the rotors (3, 3*a*) perform an opposed rotor rotation, and the dividing walls (6, 6*a*) engage into one another in a gearwheel-like manner, a running housing part (7), wherein the running housing part (7) encloses the rotors (3, 3*a*) without contact, wherein the
(Continued)

rotors (3, 3*a*) form, with the running housing part (7), at least one conveying chamber (8, 8*a*) for the fluid to be conveyed, wherein the conveying chamber (8, 8*a*) migrates axially along the rotor axis (10, 10*a*) and conveys the fluid from a suction chamber (11) into a pressure chamber (12), a suction-side connector element (13) which is connected fluidically to the suction chamber (11), and a pressure-side connector element (14) which is connected fluidically to the pressure chamber (12), wherein the suction-side connector element (13) and the pressure-side connector element (14) are arranged on a connector housing part (15) of the multiple-piece housing (2, 7, 15, 21), wherein the housing (2, 7, 15, 21) has a planar dividing plane (16) which runs parallel to the rotor axes (10, 10*a*) between the running housing part (7) and the connector housing part (15).

17 Claims, 7 Drawing Sheets

(51) Int. Cl.

| | |
|---|---|
| ***F04C 2/08*** | (2006.01) |
| ***F01C 21/10*** | (2006.01) |
| ***F04C 2/16*** | (2006.01) |
| ***F04C 15/00*** | (2006.01) |

(52) U.S. Cl.
CPC ..... *F04C 15/0069* (2013.01); *F04C 15/0096* (2013.01); *F04C 2240/30* (2013.01); *F04C 2240/70* (2013.01)

(56) References Cited

U.S. PATENT DOCUMENTS

| | | | | | |
|---|---|---|---|---|---|
| 3,288,077 | A * | 11/1966 | Meskat | F04C 2/16 | 418/55.1 |
| 3,696,736 | A * | 10/1972 | Studli | B29C 48/6801 | 100/146 |
| 4,028,027 | A * | 6/1977 | Worz | F04C 2/086 | 418/201.1 |
| 4,137,006 | A * | 1/1979 | Becker | F04D 29/40 | 29/463 |
| 4,551,065 | A * | 11/1985 | Becker | F01D 25/24 | 220/4.04 |
| 5,063,661 | A * | 11/1991 | Lindsay | F01D 25/24 | 29/888.02 |
| 5,209,937 | A * | 5/1993 | Kangas | F04C 2/086 | 425/183 |
| 5,601,414 | A * | 2/1997 | DiRe | F04C 14/28 | 417/44.2 |
| 6,623,262 | B1 * | 9/2003 | McKeithan | F04C 15/0049 | 418/1 |
| 7,198,465 | B1 * | 4/2007 | Ichiryu | F01D 25/243 | 415/214.1 |
| 9,243,631 | B2 * | 1/2016 | Patton | F04C 14/28 | |
| 2008/0181804 | A1 * | 7/2008 | Tanigawa | F04C 25/02 | 418/206.1 |
| 2012/0251357 | A1 * | 10/2012 | Yokoi | B60H 1/00514 | 417/410.1 |
| 2014/0255215 | A1 * | 9/2014 | Yin | F04B 49/106 | 417/53 |
| 2014/0286806 | A1 * | 9/2014 | Holbrook | F01C 19/005 | 418/5 |

FOREIGN PATENT DOCUMENTS

| | | | |
|---|---|---|---|
| DE | 2001000 | | 7/1971 |
| DE | 19749572 | A1 | 5/1999 |
| DE | 202006018129 | U1 | 5/2008 |
| DE | 102009052856 | B3 | 9/2010 |
| DE | 102013102032 | A1 | 9/2014 |
| EP | 0283755 | A1 | 9/1988 |
| EP | 2606234 | A2 | 6/2013 |
| GB | 645817 | | 11/1950 |
| WO | 2006/087208 | A1 | 8/2006 |
| WO | 2016004179 | A1 | 1/2016 |

OTHER PUBLICATIONS

Written Opinion of the International Searching Authority with English Translation issued in the corresponding International Patent Application No. PCT/EP2017/077555, dated Jan. 23, 2018 (10 pages).

International Preliminary Report on Patentability issued in the corresponding International Patent Application No. PCT/EP2017/077555, dated Apr. 30, 2019 (6 pages).

* cited by examiner

HORIZONTALLY SPLIT SCREW-SPINDLE PUMP

The invention relates to a screw pump or screw-spindle pump, in particular a single- or multi-flow twin screw pump or twin screw-spindle pump, comprising a multi-part housing and at least two coupled, chamber-forming rotors that each comprise at least one thread-like profiling that is formed at least in regions and that has helical channels and partition walls defining the channels, wherein the rotors perform a counter-rotating rotor rotation and the partition walls mesh with one another in the manner of gears, and a running housing part, wherein the running housing part surrounds the rotors in a contactless manner, wherein the rotors, together with the running housing part, form at least one delivery chamber for the fluid that is to be delivered, wherein the delivery chamber migrates axially along the rotor axes and zo delivers the fluid from a suction chamber into a pressure chamber, a suction-side connection element that is fluidically connected to the suction chamber, and a pressure-side connection element that is fluidically connected to the pressure chamber.

Screw pumps of this kind are known from DE 716 161 A, DE 197 49 572 A1, DE 20 01 000 A, DE 20 01 015 A, GB 645 817 A and U.S. Pat. No. 5,601,414 A. A pump of this kind is suitable for delivering fluids, such as fluid plastics material or other chemical products. A disadvantage of the known pump, however, is the significant manufacturing and maintenance outlay. In particular the mounting of the rotors in the removable side wall of the pump housing results in complex adjustment of the rotors after the pump housing has been dismantled for cleaning and maintenance.

Production by means of steel casting is difficult owing to the complicate shape and the double-walled structure, in portions, between the spindle bore and the pump housing.

The problem addressed by the invention is therefore that of specifying a screw pump that allows for simple manufacture and maintenance.

According to the invention, this problem is solved by a screw pump having the features of claim 1.

According to the invention, the screw pump is characterized in that the suction-side connection element and the pressure-side connection element are arranged on a connection housing part of the multi-part housing, wherein the housing comprises a largely planar dividing plane, extending in parallel with the rotor axes, between the running housing part and the connection housing part.

This allows for significantly simpler manufacture and maintenance. Furthermore, a modular construction of the pump can be achieved, in that it is possible to combine different running housing parts and different connection housing parts with one another. In addition, it is possible to almost entirely dispense with undercuts and double walls in the housing parts, with the result that the manufacture of the parts in a casting process is significantly simplified. In addition to castings, special materials can also be processed in an advantageous manner as a result thereof. The planar dividing plane furthermore provides simple and long-lasting sealing possibilities between the housing parts of the pump housing. Arranging the suction-side and pressure-side connection element in a common connection housing part which can be easily separated from the running housing part by the dividing plane furthermore makes it possible for the connection housing part to remain in the pipe connection during maintenance work. That is to say that the suction-side and the pressure-side connection element can remain connected to the pipes during maintenance work.

Multi-flow screw pumps are to be understood as pumps, in the running housing part of which two or more screw pairs are arranged which then operate in parallel between a common pressure chamber and a common suction chamber.

According to an advantageous embodiment of the invention, the dividing plane extends through the suction chamber and the pressure chamber. Such a course of the dividing plane provides advantages with respect to modularity and maintenance. Furthermore, such a course of the dividing plane has further advantages during manufacture, since hardly any undercuts are required. The dividing plane does not extend inside the spindle shafts, and therefore said shafts are not directly exposed when the running housing part and connection housing part are dismantled.

In an advantageous embodiment, the rotors are mounted in the running housing part. The centering means of the mounting, or the mounting itself, are contained in the running housing part. Mounting the rotors in the running housing part makes assembly during manufacture simpler and also reduced the outlay during maintenance of the pump. For the purpose of mounting the rotors in the running housing part, said part also comprises the centering means for the mounting of the rotors. Furthermore, the position of the rotors in the running housing part can be zo checked, as a result of the improved accessibility, prior to forming the connection to the connection housing part. This makes it possible to easily ensure that the running housing part surrounds the rotors in a contactless manner, and that the rotors, together with the running housing part, form at least one sealed delivery chamber.

According to an advantageous embodiment of the invention, the running housing part is integral. The integral design of the running housing part provides particular advantages when aligning and mounting the rotors in the running housing part. The integral design of the running housing part provides the advantage, in particular together with the mounting of the rotors in the running housing part, that no additional tolerances have to be taken into account in the assembly process, when positioning the rotors. Additional tolerances of this kind generally result from the housing part that, together with the rotors, forms the delivery chamber being different from the component that mounts the rotors.

A particularly advantageous development is the one in which the connection housing part is integral. An integral design of the connection housing part facilitates the assembly together with the further housing parts of the pump and the pipe system that is connected to the pump. The manufacture of the connection housing part is also significantly simplified by means of the integral design.

According to a preferred embodiment, the connection housing part together with the running housing part forms the suction chamber and the pressure chamber. Forming the suction chamber and the pressure chamber by means of the connection housing part and the running housing part allows for simple accessibility of the chambers formed by the housing parts, when dismantling the running housing part from the connection housing part.

A particularly advantageous development is the one in which the connection housing part comprises a partition wall between the suction chamber and the pressure chamber. Said partition wall can be designed in different manners, depending on the requirements at the site at which the pump is used, for example in order to adjust the delivery direction of the pump. If what is known as an "in-line" configuration of the connection elements is required, the partition wall between the suction chamber and the pressure chamber can be designed differently compared with the design in the case of other desired configurations of the connection housing part in which the connection elements are arranged so as to be mutually offset or at an angle. Here, too, separating the running housing part and the connection housing part provides for flexible adaptation options for the pump owing to the modularity that is achieved.

The embodiment in which a pressure compensation element is arranged in the partition wall is additionally advantageous. The pressure compensation element between the pressure chamber and the suction chamber prevents damage to the pump if, for example, the pipe system connected to the pressure chamber is blocked. In this case, the pressure compensation element, formed as an overload valve, would dissipate the overpressure, generated in the pressure chamber, towards the suction chamber, and thus prevent damage to the pump and the pipe system. It is particularly advantageous to arrange a pressure compensation element in the partition wall, since this can be achieved with little assembly outlay and the construction is less prone to faults.

An advantageous embodiment of the invention provides for a plurality of dividing planes that are in parallel with the rotor axes. Further additional functions, such as pressure protection means, flushing connections, bypass means, etc. can be provided on said additional dividing planes which provide the same access to the suction and pressure chamber of the pump as the first dividing plane does to the connection housing.

According to an advantageous embodiment of the invention, a flat seal is arranged between the running housing part and the connection housing part. The planar design of the dividing plane between the running housing part and the connection housing part makes it possible to use a flat seal between the housing parts of the pump. In this case, it is particularly advantageous that flat seals can be assembled relatively simply, and are long-lasting and not prone to faults. The flat seals provide huge advantages in particular with respect to media and temperature resistance.

According to an alternative embodiment of the invention, an O-ring seal is arranged between the running housing part and the connection housing part.

According to an advantageous embodiment of the invention, at least one support foot is provided on the connection housing part. Arranging a support foot on the connection housing part allows for the connection housing part to support itself independently on the ground. This is particularly advantageous when the running housing part is dismantled for maintenance and the connection housing part remains in the connected pipe connection. As a result, the connection housing part does not stress the pipe connection during the maintenance work. Moreover, this allows for central suspension. In addition, the running housing part can be mechanically decoupled thereby.

According to a preferred embodiment, the rotors can be driven by means of a drive arranged in a drive housing part of the multi-part housing. Arranging the drive in a drive housing part increases the modularity of the pump housing. It is thus possible to combine various running housing parts and connection housing parts with different to drives in order to be able to optimally adjust the screw pump to the requirements of the purpose and location of use. The drive can be directly connected via a shaft that is guided out of the housing.

According to an advantageous embodiment of the invention, the drive comprises a magnet coupling. Incorporating a magnet coupling into the drive of the screw pump makes it possible to achieve mechanical separation between the delivery medium and the drive assembly, which allows for safe delivery for example of combustible or otherwise reactive or toxic fluids.

A further advantageous embodiment is the one in which the housing comprises a planar dividing plane between the running housing part and the drive housing part. The planar dividing plane provides simple and long-lasting sealing possibilities between the housing parts of the pump housing.

A further advantageous embodiment is the one in which a flat seal is arranged between the running housing part and the drive housing part. The planar design of the dividing plane between the running housing part and the drive housing part makes it possible to use a flat seal between the housing parts of the pump. In this case, it is particularly advantageous that flat seals can be assembled relatively simply, and are economical, long-lasting and not prone to faults.

According to an alternative embodiment of the invention, an O-ring seal is arranged between the running housing part and the drive housing part.

A further advantageous embodiment is one in which the running housing part can be heated. The rotors directly positioned in the running housing part can thus also be heated directly, together with the running housing part. Directly heating the running housing part allows for delivery of media that are fluid only in a heated state. These may be in particular plastics materials, for example MDI plastics materials.

Further features, properties and advantages of the invention can be found in the following description and with reference to the drawings. Embodiments of the invention are shown purely schematically in the following drawings and will be described in greater detail in the following. Mutually corresponding objects or elements are provided with the same reference signs in all of the figures. In the figures.

Figure 1:
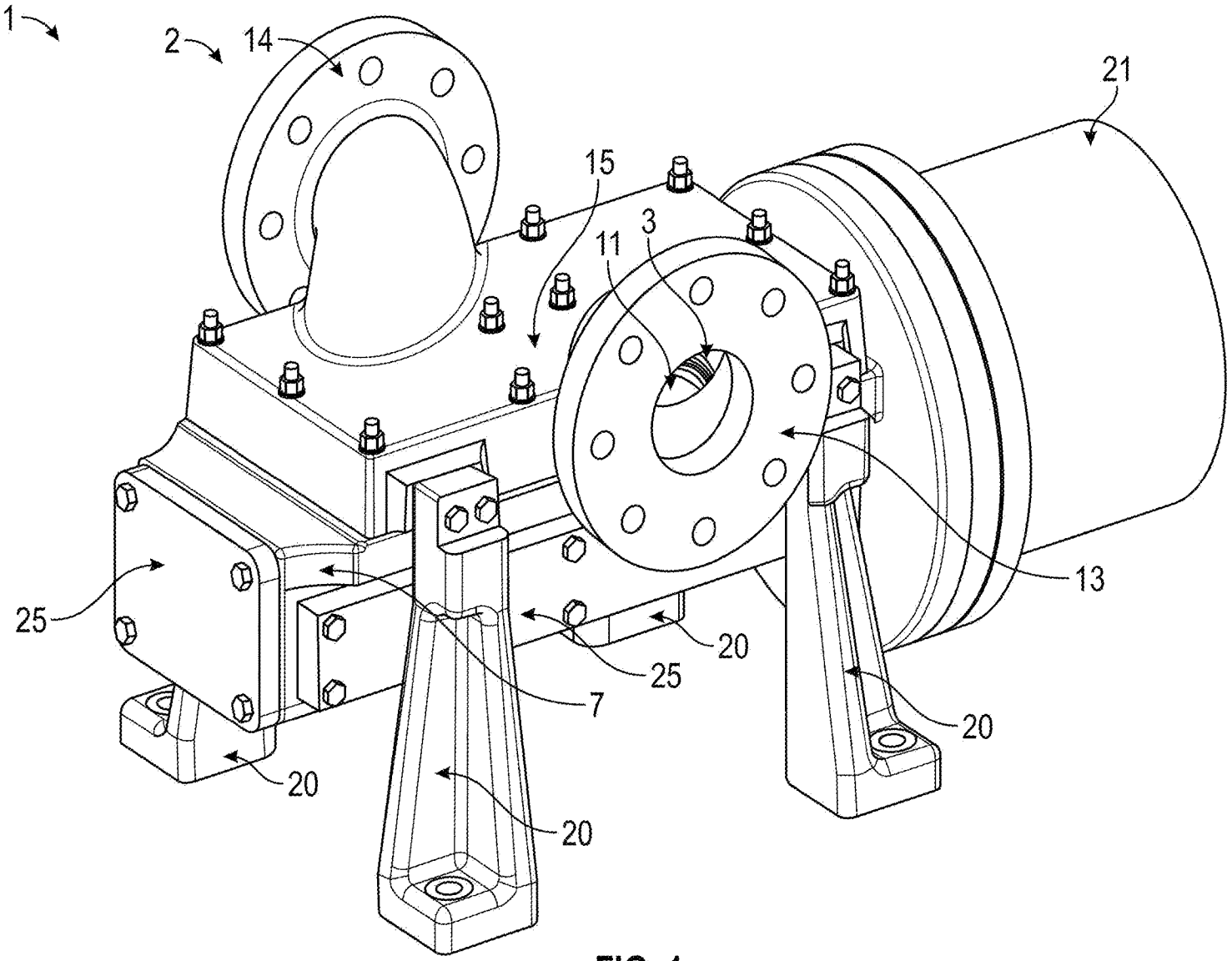
FIG. 1 is a schematic view of a screw pump according to the invention.

FIG. 1 schematically shows a screw pump 1, denoted by reference sign 1. The drawing according to FIG. 1 shows a screw pump 1 that comprises a multi-part housing 2. The housing 2 comprises a running housing part 7 and a connection housing part 15, as well as a drive housing part 21.

In addition to these housing parts 7, 15, 21, further housing part components may be provided for attachment to said housing parts 7, 15, 21. It is thus possible to provide a drainage housing to be assembled on the housing parts 7, 15, 21, wherein the drainage housing preferably comprises components that allow for drainage of the screw pump 1 for the purpose of maintenance. Furthermore, an attachment housing comprising flushing connections can be provided for checking and cleaning the screw pump 1. A pressure limiting valve housing and a bypass housing are also possible, for assembly on the modular housing parts 7, 15, 21 of the screw pump 1. Furthermore, a mountable pressure compensation housing comprising lines for pressure compensation of the screw-spindle pump rotors can be provided on the housing 2 of the screw pump 1. Furthermore, it is possible to provide for attachment of a separate recirculation housing, for example in order to provide controlled recirculation of fluid when adjusting the capacity. It is furthermore conceivable to is provide a safety valve adapter housing as an attachment part on the housing parts 7, 15, 21 of the screw pump 1, by means of which safety valves or rupture discs can be connected. An attachable transmission cover may also be provided. Further modular additional housings having additional functions are possible. In order to attach the modular additional housings (not shown) to the housing 2 of the screw pump 1, a plurality of cover plates 25 are provided on the running housing part 7, which cover plates can be removed in order to assemble an additional housing. The cover plates 25 also facilitate more simple maintenance because they cover openings in the inside of the pump housing 2, for example towards the suction chamber 11. As can be clearly seen in FIG. 1, the suction-side connection element 13 and the pressure-side connection element 14 are arranged on a common connection housing part 15 of the multi-part housing 2. The connection housing part 15 is integral. This facilitates assembly together with the further housing parts 7, 21 of the pump 1, since fewer parts have to be aligned relative to one another. Forming the connection housing part 15 separately makes it possible to change the position of the connection elements 13, 14 on the connection housing part 15 by means of exchanging said component, without it being necessary to make changes to the running housing part 7 for this purpose. As a result it is possible for example to change the delivery direction of the pump 1 without it being necessary to adjust the running housing part 7. The connection housing part 15 comprises a total of four support feet 20 in order to be able to support itself independently on the substrate. A foot heating means is s provided on the support feet 20. The running housing part 7 can be heated by this or by further attachable heating elements, for example in order to ensure the desired viscosity of the delivered fluid.

Figure 2:
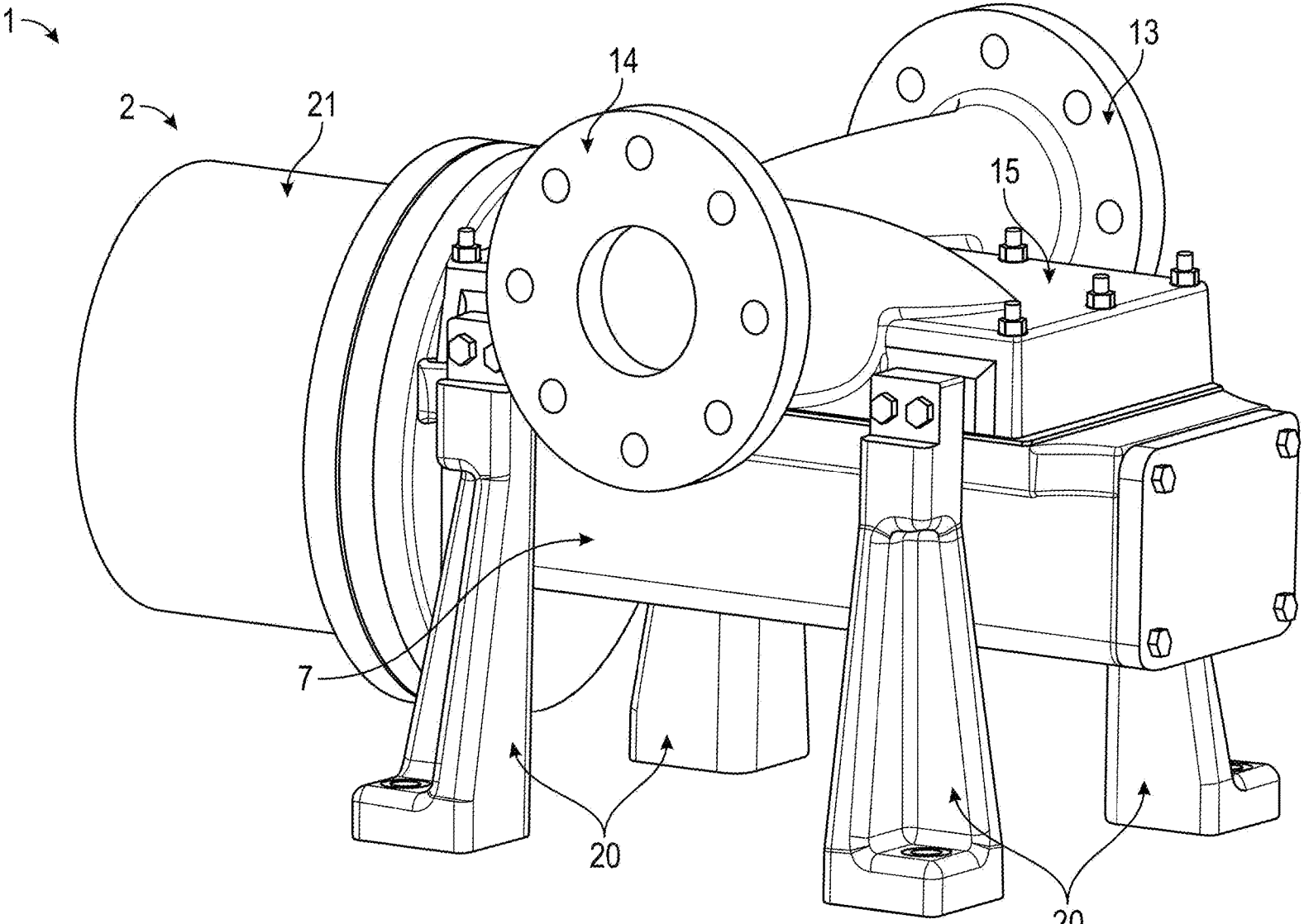
FIG. 2 is a further schematic view of a screw pump according to the invention.

FIG. 2 is a schematic view of a screw pump 1. The perspective is different from FIG. 1 in order to allow for a better view of the suction-side connection element 14.

Figure 3:
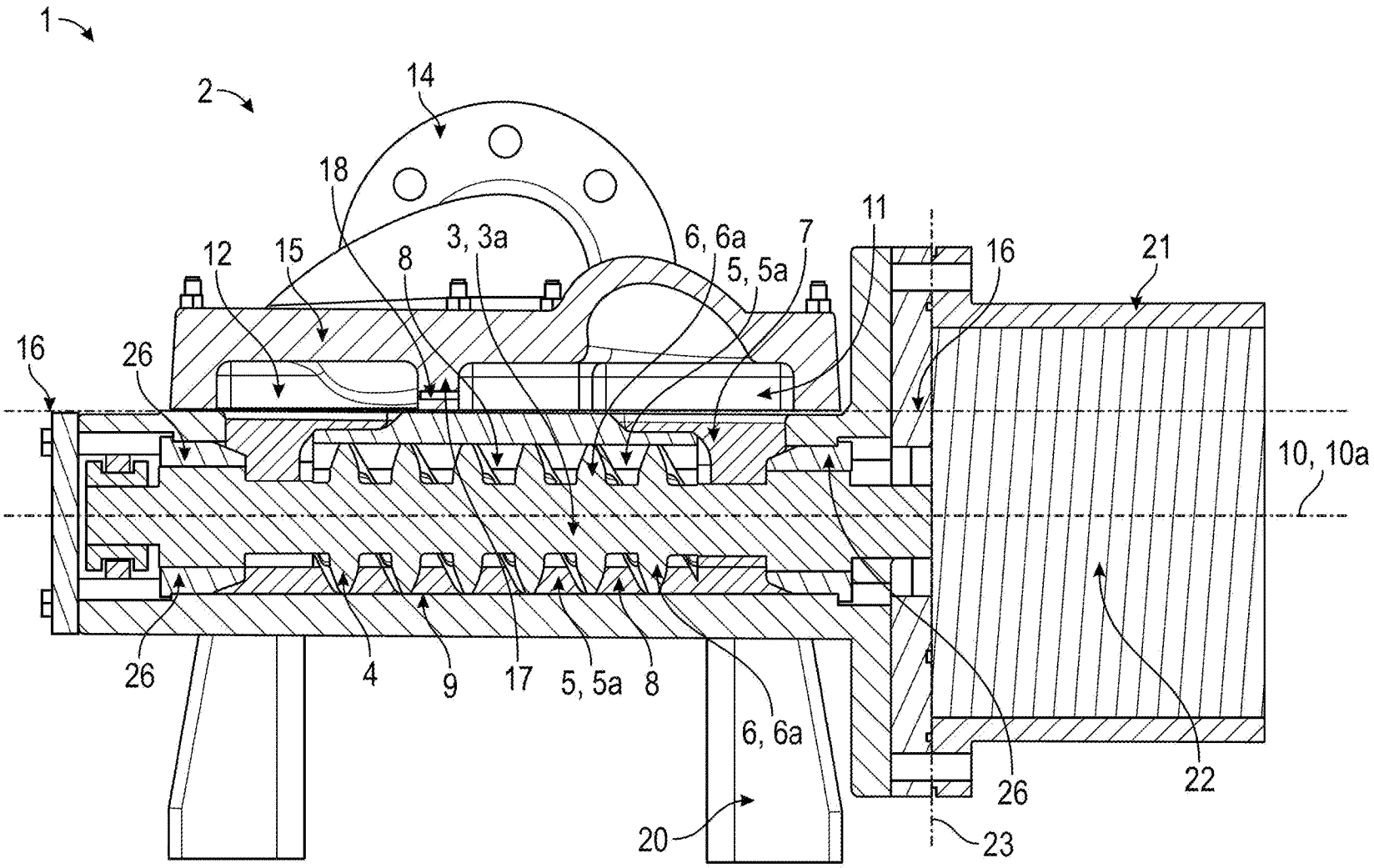
FIG. 3 is a schematic cross-section of a screw pump according to the invention.

FIG. 3 is a schematic cross-section through the housing 2 of a screw pump 1 according to the invention. along a rotor 3, 3*a* of the screw pump 1. The screw pump 1 comprises two coupled, chamber-forming rotors 3, 3*a* that each comprise at least one thread-like profiling 4, 4*a* that is formed at least in regions and that has helical channels 5, 5*a* and partition walls 6, 6*a* defining the channels 5, 5*a*. The rotors 3, 3*a* perform a counter-rotating rotor rotation about the rotor axes 10, 10*a*, such that the partition walls 6, 6*a* of the two rotors 3, 3*a* mesh with one another in the manner of gears. The running housing part 7, together with a spindle bore 9, forms the outer wall for the rotors 3, 3*a*. The rotors 3, 3*a*, together with the running housing part 7, form a delivery chamber 8, 8*a* for the fluid to be delivered. During pumping operation, the delivery chambers 8, 8*a* migrate axially along the rotor axes 10, 10*a*, owing to the rotation of the rotors 3, 3*a*. As a result, the fluid is delivered from a suction chamber 11 into a pressure chamber 12. Even though only two chamber-forming rotors 3, 3*a* (FIG. 4) are shown in the embodiment, the invention is not limited thereto. It is thus possible for further rotors to be provided in the screw pump 1. Th rotors 3, 3*a* are mounted in the running housing part 7 by means of bearings 26. For this purpose, receptacles or centering means for the mounting are accommodated in the running housing part 7. The integral design of the running housing part 7 allows for simple alignment and mounting the rotors 3, 3*a* in the running housing part 7. The integral design of the running housing part 7, in particular together with the mounting of the rotors 3, 3*a* in the running housing part 7, allows for the possibility that no additional tolerances have to be taken into account, by further components, when positioning the rotors 3, 3*a*. As can be seen, the connection housing part 15, together with the running housing part 7, forms the suction chamber 11 and the pressure chamber 12. The connection housing part 15 comprises a partition wall 17 between the suction chamber 11 and the pressure chamber 12. A pressure compensation element 18 is arranged in the partition wall 17, which element can, dissipate an overpressure, generated in the pressure chamber 12, towards the suction chamber 11, and thus prevent damage to the pump and to the pipe system connected to the screw pump 1. Between the running housing part 7 and the connection housing part 15, the housing 2 comprises a planar dividing plane 16 that extends so as to be in parallel with the rotor axes 10, 10*a*. Said dividing plane 16 forms a connection flange between the connection housing part 15 and the running housing part 7. The rotors 3, 3*a* are driven, for pumping operation, by means of a drive 22 arranged in a drive housing part 21 of the multi-part housing 2. Said drive 22 comprises a magnet coupling which is arranged in a drive housing part 21 formed as a flange housing. Advantageously, a further planar dividing plane 23 is provided between the running housing part 7 and the drive housing part 21. A further flat seal 23 is arranged on said dividing plane 24 between the running housing part 7 and the drive housing part 21. The further attachable additional housings are preferably also connected to the pump housing 2 by means of planar dividing planes, and more preferably sealed with respect to one another by means of further flat seals on said dividing planes. Further dividing plane are also possible within the running housing part 7, the connection housing part 15 or the drive housing part 21. Here, too, further flat seals for sealing the housing parts relative to one another are expedient.

Figure 4:
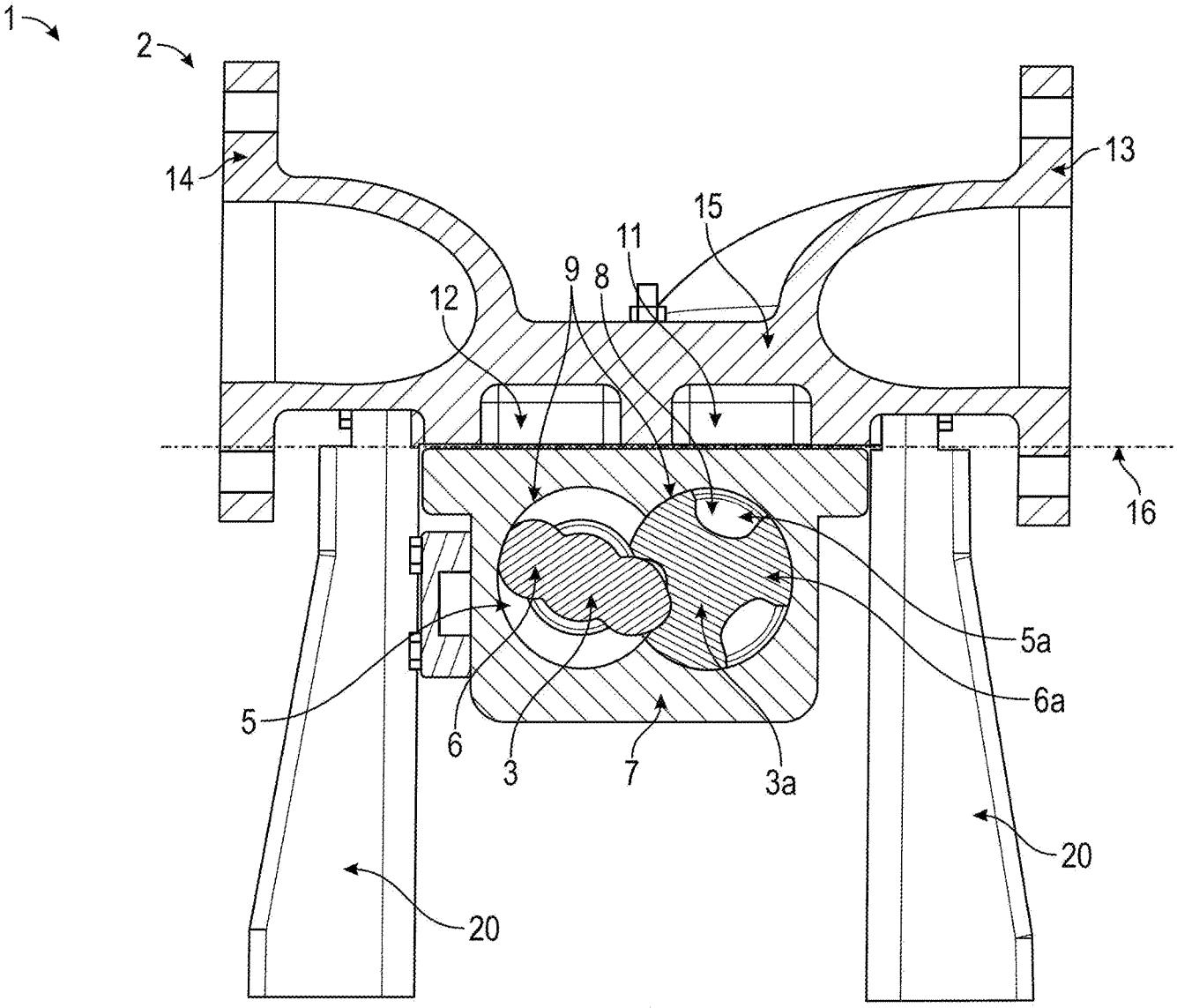
FIG. 4 is a further schematic cross-section of a screw pump according to the invention.

FIG. 4 discloses a schematic cross-section through the modular housing 2 of a screw pump 1 according to the invention, viewed from the rotor axes 10, 10*a* (FIG. 3). The multi-part housing 2 of the screw pump 1 comprises the running housing part 7 which surrounds the two rotors 3, 3*a*, in an 8-shaped spindle bore 9, in a contactless manner. The running housing part 7 thus forms the outer wall for the rotors 3, 3*a*.

The rotors 3, 3*a*, together with the running housing part 7, form a plurality of delivery chambers 8, 8*a* (FIG. 3) for the fluid to be delivered. During pumping operation, the delivery chambers 8, 8*a* (FIG. 3) migrate axially along the rotor axes 10, 10*a* (FIG. 3), owing to the rotation of the rotors 3, 3*a*. As a result, the fluid is delivered from the suction chamber 11 into the pressure chamber 12. During pumping operation, the medium to be delivered is conducted from a pipe system connected to the connection element 13, into the suction chamber 11, by means of a suction-side connection element 13 that is fluidically connected to the suction chamber 11. A pressure-side connection element 14 that is fluidically connected to the pressure to chamber 12 provides a connection to a pipe system in which the delivered medium is conducted. As shown in the embodiment, connection flanges 13, 14 are possible as connection elements 13, 14 in this region. Between the running housing part 7 and the connection housing part 15, the housing 2 comprises a largely planar dividing plane 16 that extends so as to-be largely in parallel with the rotor axes 10, 10*a*. Said dividing plane 16 forms a connection flange between the connection housing part 15 and the running housing part 7. The connection housing part 15 connects the process connections (suction line, pressure line) at the connection elements 13, 14 to the running housing part 7.

Figure 5:
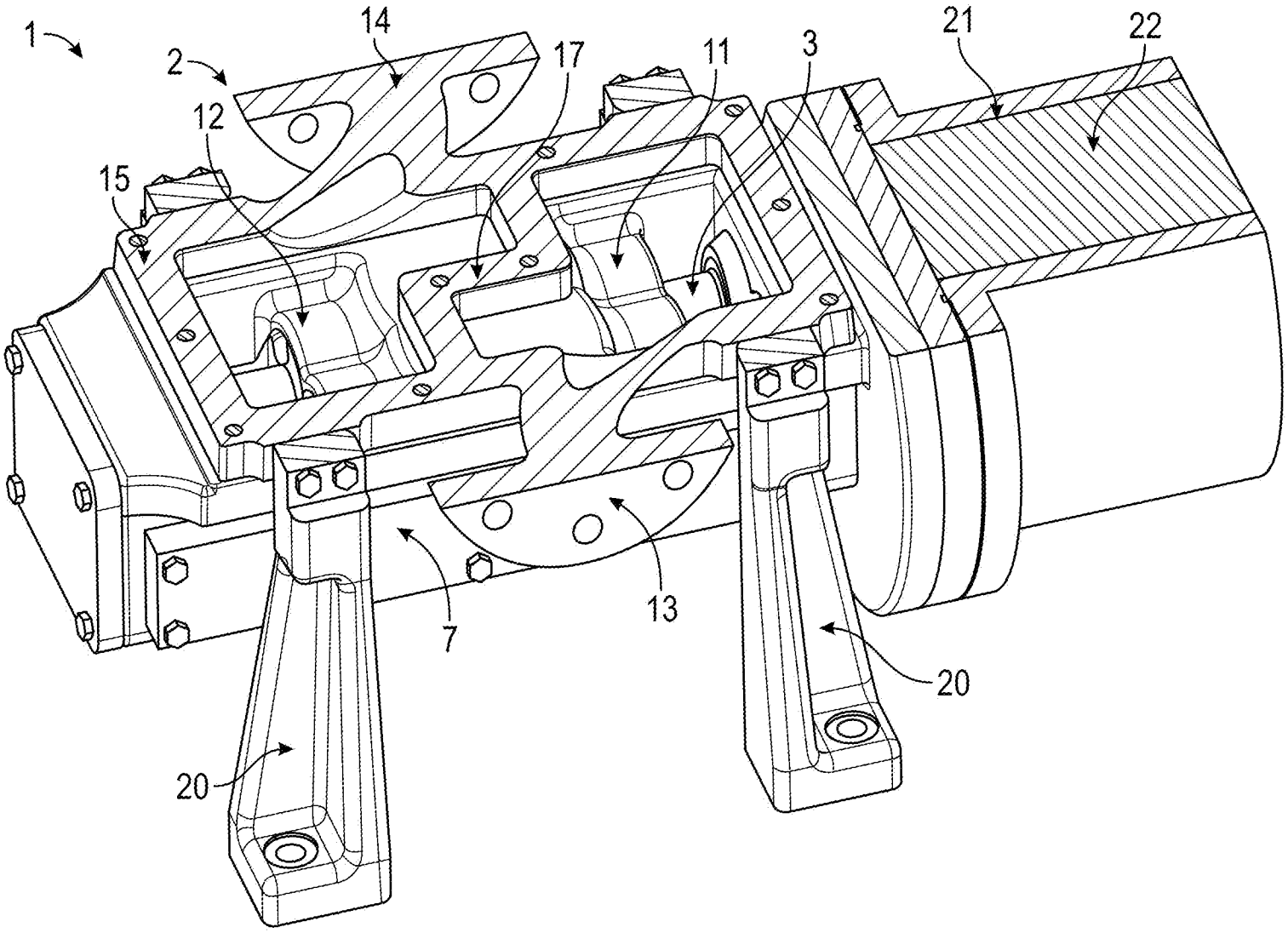
FIG. 5 is a further schematic cross-section of a screw pump according to the invention.
Figure 6:
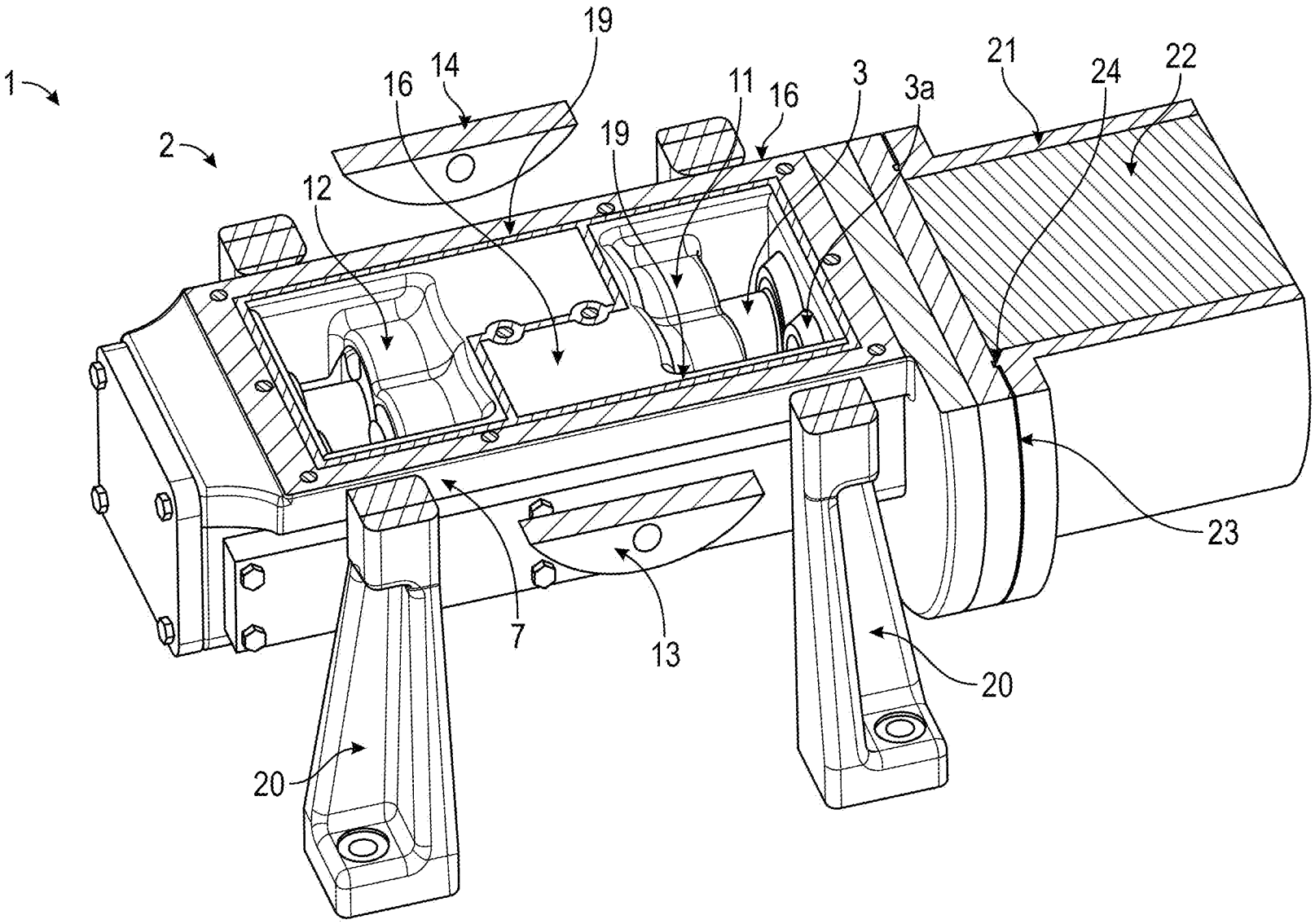
FIG. 6 is a further schematic cross-section of a screw pump according to the invention.

FIG. 5 is a schematic cross-section of a screw pump 1 according to the invention, through the connection housing part 15 and the drive housing part 21 comprising the drive 22. The cutting plane extends in parallel with the rotor axes 10, 10*a* (FIG. 3) and the dividing plane 16 (FIGS. 4 and 6). It can be clearly seen that the connection housing part 15, together with the running housing part 7, forms the suction chamber 11 and the pressure chamber 12. The connection housing part 15 comprises a partition wall 17 between the suction chamber 11 and the pressure chamber 12. Said partition wall 17 can be designed in different manners, depending on the requirements at the site at which the pump 1 is used, for example in order to adjust the delivery direction of the pump 1.

FIG. 6 is a schematic cross-section of a screw pump 1 according to the invention, through the dividing plane 16 (FIG. 4). As can be seen, the dividing plane 16 extends through the suction chamber 11 and the pressure chamber 12. It can furthermore be clearly seen that a flat seal 19 is arranged on the planar dividing plane 16, between the running housing part 7 and the connection housing part 15 (FIG. 4). Since the s section also extends through the drive housing part 21 and the drive 22, the flat seal 24 located between the housing parts can be seen on the dividing plane 23 between the drive housing part 21 and the running housing part 7.

Figure 7:
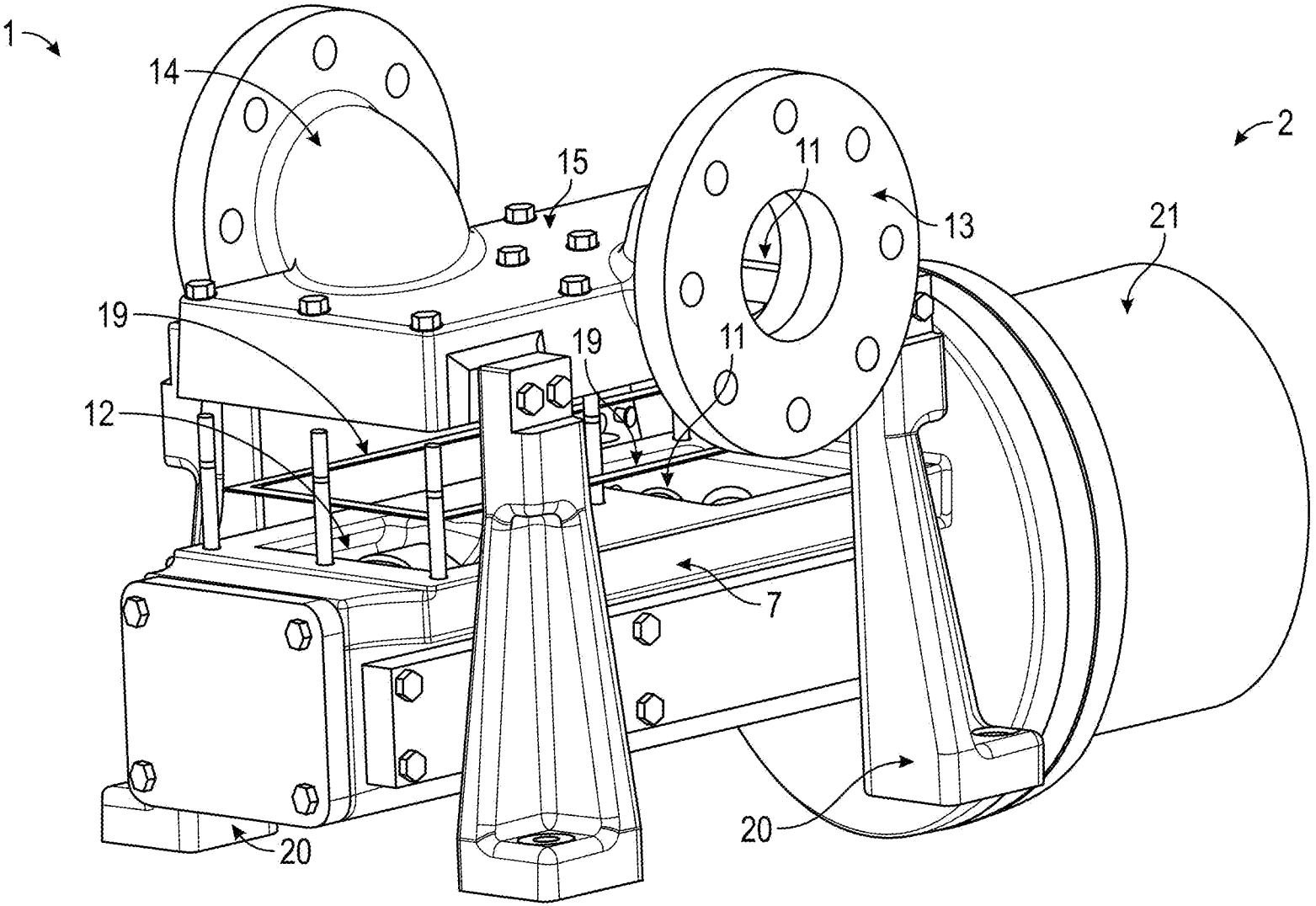
FIG. 7 is a schematic exploded view of a screw pump according to the invention.

FIG. 7 discloses a schematic exploded view of a screw pump 1 according to the invention. In this case, the connection housing part 15 is raised off the running housing part 7, such that the likewise raised flat seal 19 and the suction chamber 11, as well as the pressure chamber 12, are visible.

It is particularly advantageous for all the pump elements, including the seals or the magnet drive, to be able to be pre-assembled and tested, in the running housing part 7, before being assembled together with the connection housing part 15

Arranging a plurality of running housing parts 7 on top of one another, i.e. a stack of running housing parts 7, advantageously makes it possible to achieve a multi-stage pump.

Furthermore, a plurality of connection housing parts 15 may be provided at a plurality of faces of the running housing part 7.

LIST OF REFERENCE SIGNS

1 screw pump
2 housing
3, 3*a* rotors
4, 4*a* profiling
5, 5*a* helical channels
6, 6*a* partition walls
7 running housing part
8 delivery chamber
9 spindle bore
10, 10*a* rotor axes
11 suction chamber
12 pressure chamber
13 suction-side connection element
14 pressure-side connection element
15 connection housing part
16 dividing plane A
17 partition wall
18 pressure compensation element
19 flat seal A
20 support foot
21 drive housing part
22 drive
23 dividing plane B
24 flat seal B
25 cover plate
26 bearing

The invention claimed is:

1. Screw pump, in particular a single- or multi-flow twin screw pump, comprising a multi-part housing and at least two coupled, chamber-forming rotors that each comprise at least one thread-like profiling that is formed at least in regions and that has helical channels and partition walls defining the channels, wherein the rotors perform a counter-rotating rotor rotation and the partition walls mesh with one another in the manner of gears, and a running housing part, wherein the running housing part surrounds the rotors in a contactless manner, wherein the rotors, together with the running housing part, form at least one delivery chamber for the fluid that is to be delivered, wherein the delivery chamber migrates axially along the rotor axes and delivers the fluid from a suction chamber into a pressure chamber, a suction- side connection element that is fluidically connected to the suction chamber, and a pressure-side connection element that is fluidically connected to the pressure chamber, wherein the suction-side connection element and the pressure-side connection element are arranged on a connection housing part of the multi-part housing, wherein the housing comprises a planar dividing plane that extends so as to be in parallel with the rotor axes, between the running housing part and the connection housing part, wherein the connection housing part is separated from the running housing part by the dividing plane, and wherein the dividing plane does not extend inside the rotor axes, so that the rotor axes are not directly exposed when the running housing part and connection housing part are dismantled, wherein the rotors are mounted in the running housing part by means of bearings.

2. The screw pump according to claim 1, wherein the dividing plane extends through the suction chamber and the pressure chamber.

3. The screw pump according to claim 1, wherein the rotors are mounted in the running housing part.

4. The screw pump according to claim 1, wherein the running housing part is integral.

5. The screw pump according to claim 1, wherein the connection housing part is integral.

6. The screw pump according to claim 1, wherein the connection housing part, together with the running housing part, forms the suction chamber and the pressure chamber.

7. The screw pump according to claim 1, wherein the connection housing part comprises a partition wall between the suction chamber and the pressure chamber.

8. The screw pump according to claim 7, wherein the partition wall further comprises a compensation element disposed therein.

9. The screw pump according to claim 1, wherein a flat seal is arranged between the running housing part and the connection housing part.

10. The screw pump according to claim 1, wherein an O-ring seal is arranged between the running housing part and the connection housing part.

11. The screw pump according to claim 1, wherein at least one support foot is provided on the connection housing part.

12. The screw pump according to claim 1, wherein the rotors are driven by means of a drive arranged in a drive housing part of the multi-part housing.

13. The screw pump according to claim 12, wherein the drive comprises a magnet coupling.

14. The screw pump according to claim 12, wherein the housing comprises a planar dividing plane, between the running housing part and the drive housing part.

15. The screw pump according to claim 12, wherein a flat seal is arranged between the running housing part and the drive housing part.

16. The screw pump according to claim 12, wherein an O-ring seal is arranged between the running housing part and the drive housing part.

17. The screw pump according to claim 1, wherein the running housing part is heated.

* * * * *